US005182884A

United States Patent [19]

Tarics

[11] Patent Number: 5,182,884

[45] Date of Patent: Feb. 2, 1993

[54] INTEGRATED BUILDING SYSTEM AND METHOD

[76] Inventor: Alexander G. Tarics, 29 Windward Rd., Belvedere, Calif. 94920

[21] Appl. No.: 684,298

[22] Filed: Apr. 12, 1991

[51] Int. Cl.[5] ..... E04B 1/34

[52] U.S. Cl. ..... 52/79.14; 52/220; 52/221; 52/234; 52/236.6

[58] Field of Search ..... 52/79.7, 79.8, 79.14, 52/234, 236.3, 236.5, 236.6, 220, 221

[56] References Cited

U.S. PATENT DOCUMENTS

| | | | |
|---|---|---|---|
| 3,377,755 | 4/1968 | Stucky et al. | 52/79.14 X |
| 3,416,273 | 12/1968 | Stucky et al. | 52/79.14 X |
| 3,500,596 | 3/1970 | Andersson | 52/79.7 |
| 3,990,193 | 11/1976 | Ray et al. | 52/79.14 X |

*Primary Examiner*—Richard E. Chilcot, Jr.

*Attorney, Agent, or Firm*—Flehr, Hohbach, Test, Albritton & Herbert

[57] ABSTRACT

Building system comprising a plurality of interconnected building blocks. Each of the building blocks has framing providing a horizontally disposed vertically spaced-apart floor, ceiling and ceiling plenum and having at least three vertically extending corners with each corner having a vertical shaft formed therein extending from the floor to the ceiling plenum. The vertical shafts have air handling ducts and piping and wiring disposed therein. The ceiling plenum has spaced-apart parallel framing members extending in one direction of the ceiling plenum. Air handling ducts are connected to the air handling ducts in the vertical shafts and are disposed in the ceiling plenum running in directions parallel to the framing members in the ceiling plenum. Piping and wiring are connected to piping and wiring in the vertical shafts and are disposed in the ceiling plenum and run in directions different from the directions of the framing members in the ceiling plenum.

15 Claims, 5 Drawing Sheets

INTEGRATED BUILDING SYSTEM AND METHOD

This invention relates to an integrated building system and method, more particularly to an integrated building system and method which utilizes building blocks or modules having unique characteristics.

In sophisticated buildings such as hospitals, research buildings and other special purpose buildings, complex service facilities therein require the coordination of the work of a number of disciplines, namely architectural, structural, civil, mechanical, and electrical engineering as well as others to provide a completed building. Typically, the coordination of these various disciplines is by the architect for the building. However in the cases the routing of air handling ducts, pipes, wiring and other service components in the ceiling plenums of the building, the construction drawings are produced by the various disciplines most of the time working independently from each other. It is not until construction occurs that conflicts are discovered, making the rerouting of such required services in the ceiling plenums by time consuming and costly change orders and corrections during the construction phase of the building. The structural columns and walls are frequently in conflict with the desire for unobstructed functional flooring requirements. Typically such buildings are designed to satisfy the first user and cannot be readily altered to accommodate future changes. Congestion of piping, wiring, air ducts and equipment in unorganized ceiling plenums, particularly in the vicinity of the conventional large centrally located vertical mechanical shafts create numerous difficulties. In order to overcome these difficulties, and to provide a need for ready access to equipment in the ceiling plenum, interstitial floors have been provided in the building during construction. Such interstitial floors typically have been located between functional floors and building equipment such as air handling ducts, pipes, wiring and other service components previously located in the ceiling plenums have been located in these interstitial floors. These additional interstitial floors although they ease the problems caused by the fragmented nature of the various design disciplines often contain unused space and significantly increase the total building volume, the overall height of the building and substantially increase the cost of construction of the building. There is therefore a need for a new and improved building system and method to make it possible to more readily coordinate the efforts of the various design disciplines to facilitate the construction of complex buildings.

In general, it is an object of the present invention to provide an integrated building system and method for organizing the routing of air handling ducts, pipes, wiring and other service components in preassigned spaces in ceiling plenums.

Another object of the invention is to provide a system and method of the above character in which there is ready access to the assigned spaces in the ceiling plenums to facilitate the making of future changes.

Another object of the invention is to provide a system and method of the above character in which the a plurality of minishafts are provided in place of a single main mechanical shaft.

Another object of the invention is to provide a system and method of the above character in which changes can be readily made through the ceiling and through removable walls in the minishafts.

Another object of the invention is to provide a system and method of the above character in which eliminates the conflicts between service components in the ceiling plenum.

Another object of the invention is to provide a system and method of the above character which eliminates wasted space in a building.

Another object of the invention is to provide a system and method in which there is less spacing between floors.

Another object of the invention is to provide a system and method of the above character which reduces construction costs for the building.

Another object of the invention is to provide a system and method of the above character which utilizes substantially identical building blocks.

Another object of the invention is to provide a system and method of the above character in which the building blocks can be stacked side by side or vertically on top of each other.

Another object of the invention is to provide a system and method of the above character which lends itself to a large scale prefabrication of components for the substantially identical building blocks.

Additional objects and features of the invention will appear from the following description in which the preferred embodiments are set forth in detail in conjunction with the accompanying drawings.

In general, the integrated building system of the present invention is comprised of a plurality of building blocks which are fitted together to form a building. Each of the building blocks has a framing providing a horizontally disposed vertically spaced-apart floor, ceiling o and ceiling plenums and having at least three vertically extending corners with at least certain of the corners having a shaft formed therein extending from the floor into the ceiling plenum. Said certain vertical shafts have air handling ducts and piping and wiring disposed therein. The ceiling plenum has spaced-apart parallel framing members extending in one direction in the plenum. Air handling ducts are disposed in preassigned spaces in the ceiling plenum and extend in a direction parallel to the structural framing members in the ceiling plenum and are connected to the air handling ducts on the vertical shafts. Piping and wiring for other services such as water and electricity are also disposed in preassigned spaces in the ceiling plenum extending in directions different from the directions of the structural framing members in the ceiling plenum and are connected to the piping and wiring in the vertical shafts.

Figure 1:
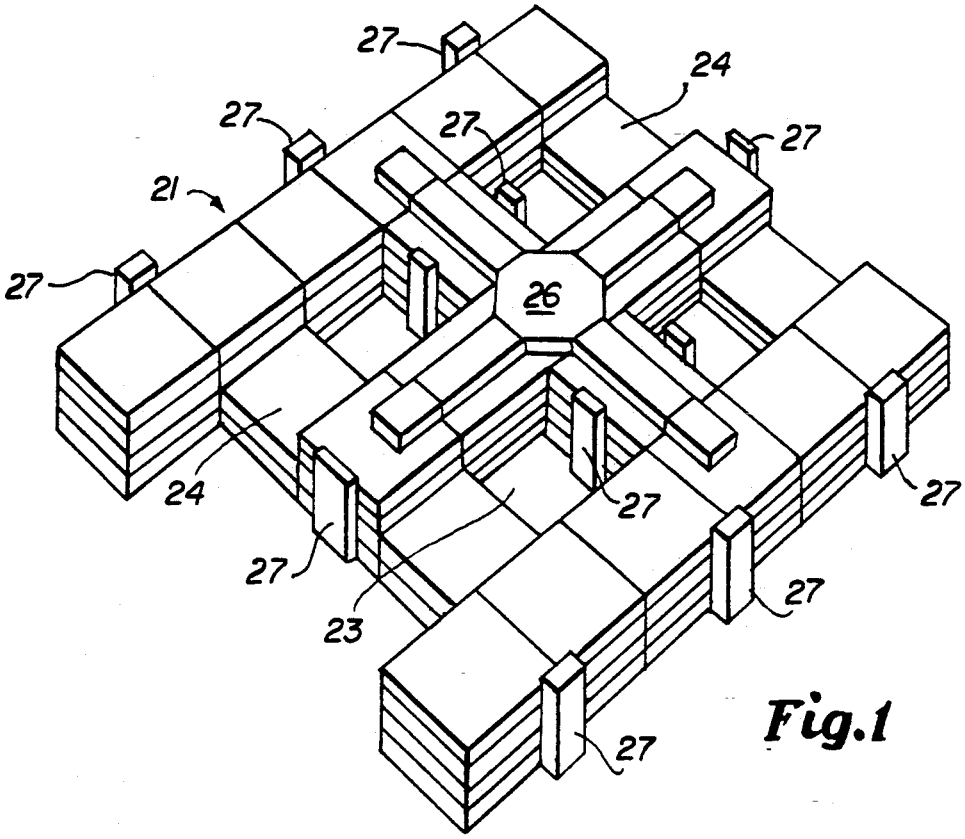
FIG. 1 is an overall perspective view of a model of a building construction incorporating the system and method of the present invention utilizing a plurality of substantially identical building blocks.

More specifically as shown in the drawings, the integrated building system of the present invention is shown utilized in a completed building 21 shown in FIG. 1. As shown therein, it has been designed as a hospital formed of building blocks 22 of the type hereinafter described. The first floor consists of 23 building blocks to provide the normal hospital functions which need ready access to the public and including out patient clinics. Four interior landscape courts 23 are provided to provide visual relief. The second floor consists of 23 building blocks 22 and is utilized for offices. The third, fourth and fifth floors are each comprised of 19 building blocks with the third floor having access to four roof terraces 24. A penthouse 26 is provided on the roof. The mechanical room and the warehouse can be located in a partial basement. A full basement under the entire floor could provide areas for future expansion or indoor parking. The necessary stairways and elevators required for the building can be provided in enclosures 27 secured to the blocks 22.

Figure 2:
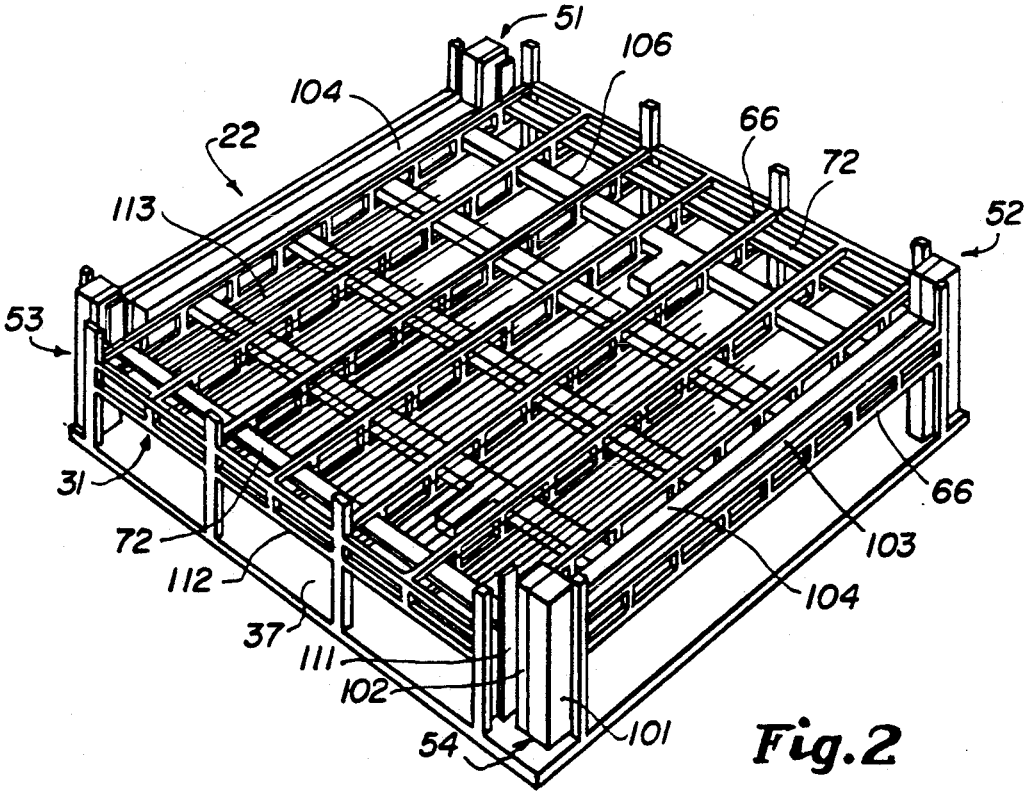
FIG. 2 is a perspective view of a model of showing portions of one of the building blocks utilized in the building shown in FIG. 1.

Each of the building blocks 22 has a desired geometrical configuration which may have an appropriate design for a specific building. Thus for example, as shown in FIG. 2, the building block 22 in plan can be rectangular or square. However it should be appreciated that in accordance with the present invention, the geometrical shape can be in the form of a parallelogram, a rhombus or a rhomboid, or even a trapezoid. It also can be in the form of a triangle or other irregular shapes as long as the shapes provide at least three corners on the outer perimeter, although the benefits of the present invention may be decreased to some extent.

Figure 3:
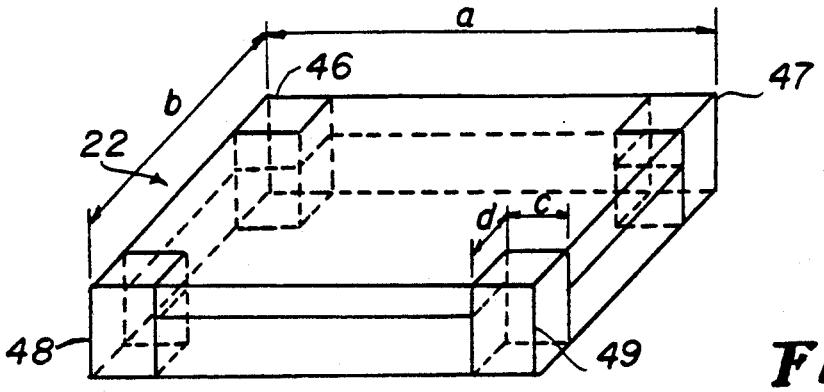
FIG. 3 is a schematic isometric view of the building block shown in FIG. 2.
Figure 4:
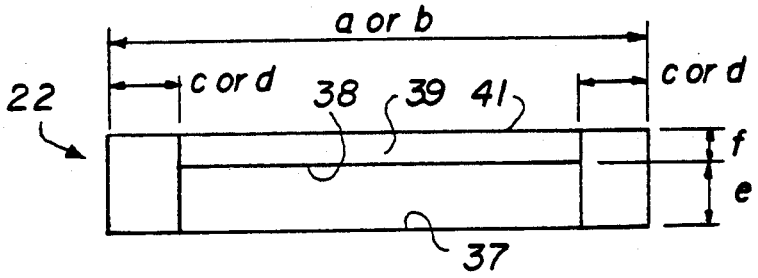
FIG. 4 is an elevational view of the building block as shown in 3.

As shown schematically in FIGS. 3 and 4, each of the building blocks 22 is provided with framing 31 which forms spaced-apart parallel front and rear walls 32 and 33 and spaced-apart parallel side walls 34 and 36 that extend in a direction perpendicular to the front and rear walls 32 and 33. The front and rear walls 32 and 33 have a length dimension "a" and the side walls 34 and 36 have a length dimension "b" as shown in FIG. 3. Each of the building blocks 22 is provided with horizontally disposed vertically spaced-apart floor 37, ceiling 38, ceiling plenum 39 and roof 41. The horizontally disposed ceiling 38 is spaced above the ceiling floor by a predetermined distance, as for example, the distance "e" shown in FIG. 4. The ceiling plenum 39 is disposed between the ceiling 38 and the horizontally disposed floor or roof 41 and has a height of dimension "f."

The framing 31 provides a plurality of corners, at least three corners and preferably four corners 46, 47, 48, 49 as shown in FIG. 3 on the outer perimeter. The framing 31 is provided with four mechanical ducts or shafts 51, 52, 53, 54 disposed in the four corners 46, 47, 48, 49. The corners 46, 47, 48, 49 and the shafts 51, 52, 53, 54 extend vertically from the floor 37 into the ceiling plenum where they are adapted to mate with corresponding shafts provided in superimposed building blocks 22.

Figure 5:
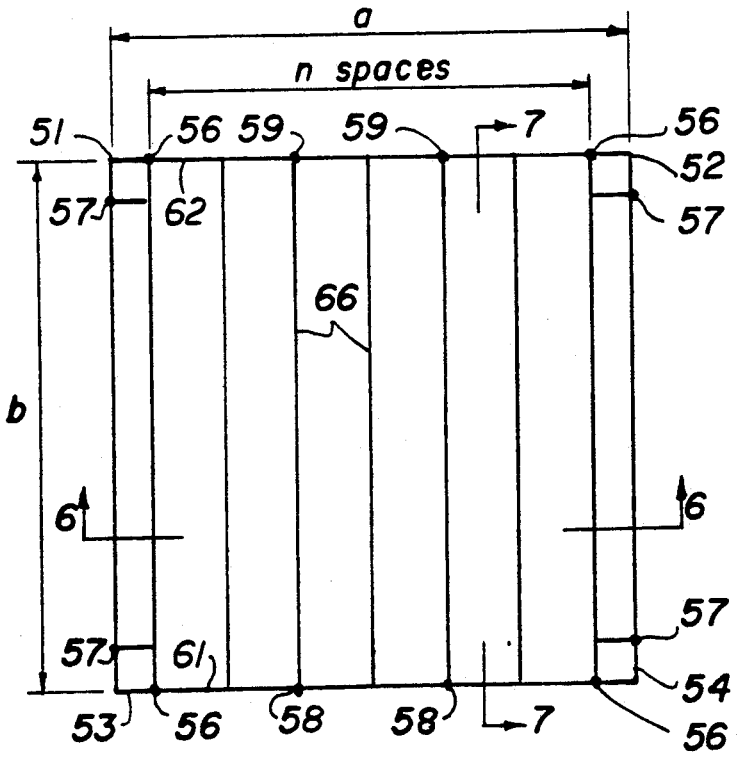
FIG. 5 is a plan view showing the framing utilized in the building block shown in FIGS. 3 and 4.

The framing 31 for the building block 22 provided in the ceiling plenum 39 is shown in FIG. 5. The building block 22 can have any appropriate size, as for example, the ceiling plenum can be 72 feet square with the dimensions "a" and "b" being equal. The framing 31 includes vertical columns 56 and 57 disposed adjacent opposite corners of the shafts 51, 52, 53, 54 and in alignment with the walls 32, 33, 34 and 36. Additional vertical columns 58 are provided in the front wall 32. Similar spaced-apart vertically disposed columns 59 and provided in the rear wall 33.

The framing 31 also includes girders 61 which are disposed between and secured to the columns 56 adjacent the shafts 53 and 54 and are secured to the columns 58. Similarly girders 62 extend between and are secured to the columns 56 adjacent the shafts 51 and 52 and are secured to the columns 59. The girders 61 and 62 are spaced apart and extend parallel to each other.

Figure 6:
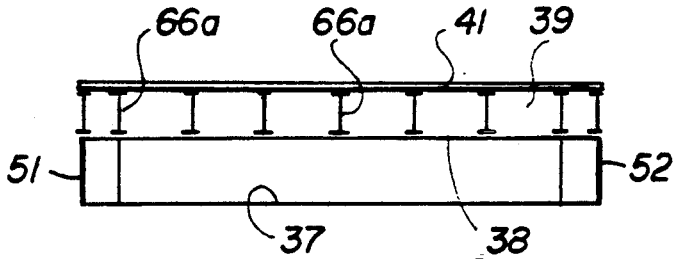
FIG. 6 is a cross-sectional view taken along line 6—6 of FIG. 5.
Figure 7:
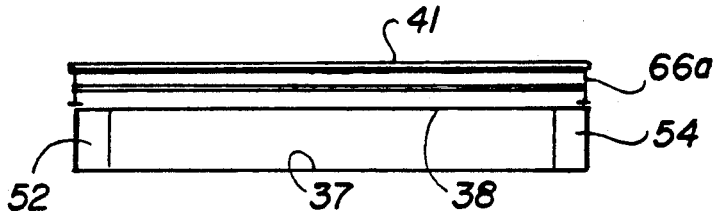
FIG. 7 is a cross-sectional view taken along line 7—7 of FIG. 5 showing use of beams for structural framing.
Figure 8:
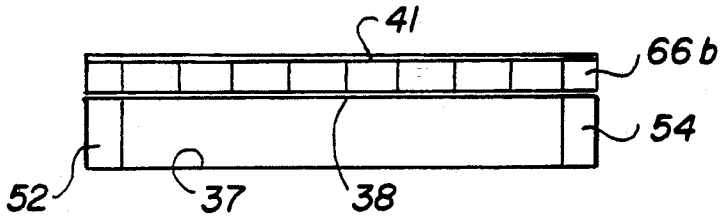
FIG. 8 is a cross-sectional view similar to FIG. 7 but showing the use of trusses without diagonals for structural framing.
Figure 9:
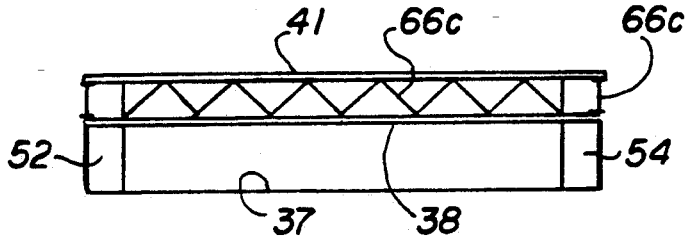
FIG. 9 is a cross-sectional view similar to FIG. 7 but showing the sue of trusses with diagonals for structural framing.

A plurality of spaced-apart parallel members 66 are provided which extend in directions perpendicular to the girders 61 and 62 secured to the columns 58 and 59 and to the columns 56 and 57 adjacent the shafts 51, 52, 53, 54. These members 66 can be in the form of trusses or beams. As shown in FIG. 6, the members 66 are disposed in the ceiling plenum 39 and are spaced-apart and parallel. The floor or roof 41 is shown in the form of a concrete slab supported by the members 66. As shown particularly in FIG. 7, the members 66 can be in the form of a beam extending between the front and rear walls 32 and 33. In FIG. 8, the members 66 have been shown in the form of trusses without diagonals and in FIG. 9 in the form of trusses with diagonals.

The construction of the building blocks hereinbefore described is particularly suited for the routing of utilities in accordance with the present invention. The four shafts 51, 52, 53, 54 provided at the four corners of the building block 22 provide the space for the vertical routing of the utilities for the building block. The shafts 51, 52, 53, 54 are connected to the building supporting machinery which is typically located in the basement and/or on the roof or on intermediate floors of the building. The shafts 51, 52, 53, 54 which can be identified as minishafts. The minishafts contain the air handling ducts, water pipes, sewer pipes, and electrical wiring. In addition for special buildings such as hospitals and the like, they can also contain laundry trash systems and dietary conveyor systems as well as other services. The minishafts 51, 52, 53, 54 carrying these utilities enter the ceiling plenum 39 in two pairs of horizontally disposed channels 71 and 72 (see FIG. 10). The channels 71 connect the minishafts 51 and 53 and minishafts 52 and 54 and run parallel with the structural framing members 66 and typically contain the air handling ducts as well as other utilities as hereinafter described.

The channels 72 connecting the minishafts 51 and 52 and the minishafts 53 and 54 extend perpendicular to or substantially perpendicular to the structural framing members 56 in the ceiling plenum 39 and typically contain the pipes and wiring for the utilities. They also contain utilities other than pipes and wiring as hereinafter described. In order to deliver the utility services over the horizontal area of the building block 22, the air handling ducts, pipes, wires and other utilities are extended in their respective channels in preassigned layers on the top of each other as shown in FIGS. 10–15. Services which must be routed on a slope may leave their assigned layers on their way to their respective channel.

Figure 10:
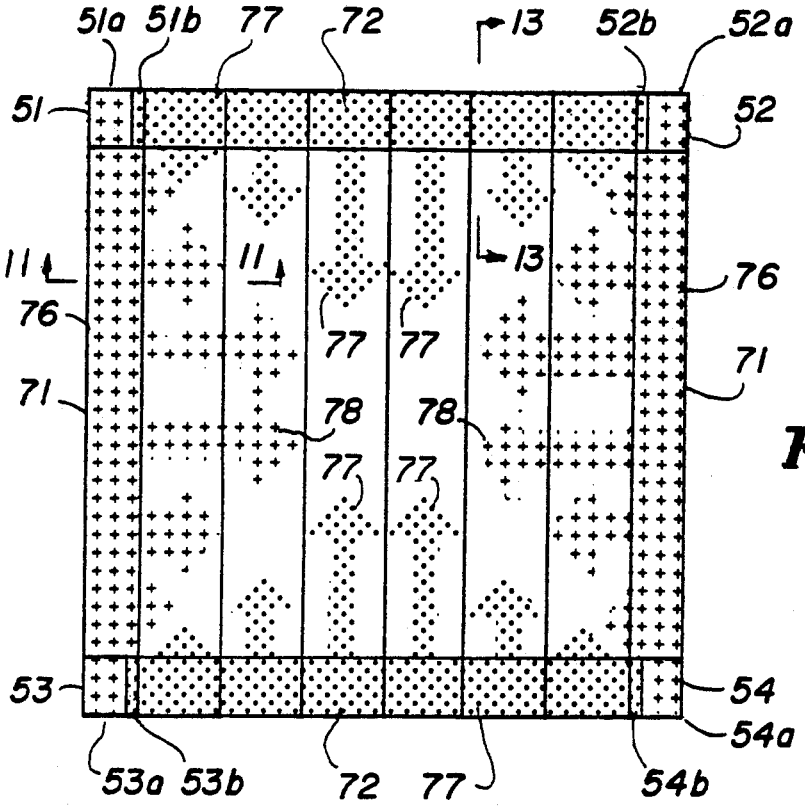
FIG. 10 is a plan view showing the schematic routing of utilities in a ceiling plenum shown in FIG. 4.

FIG. 10 shows the routing of the utilities for the building block and as shown therein the spaces occupied by the channels 71 are represented by the areas containing crosses 76 therein whereas the areas are represented by the channels 72 in the ceiling plenum 39 are the areas filled with dots 77. Thus it can be seen that the channels 72 extend perpendicular to the channels 71. The distribution of the utilities from the channels 71 is represented by arrows 78 which extend in directions that are perpendicular to the channels 71. Similarly, the distribution of the utilities from the channel 72 is represented by arrows 79 that extend in directions which are perpendicular to the channels 72. As can be seen in FIG. 10, the arrows 78 and 79 are provided with the appropriate crosses 76 or dots 77 to represent the utilities being distributed thereby.

The vertical spaces in the vertical minishafts 51–54 are also assigned or segregated. The major portions thereof 51*a*, 52*a*, 53*a* and 54*a* are assigned for the air handling ducts and the minor portions 51*b*, 52*b*, 53*b* and 54*b* are assigned for the piping. As shown in FIG. 10, these assigned areas in the minishafts 51, 52, 53, 54 have been provided with the appropriate crosses and dots 76 and 77.

Figure 11:
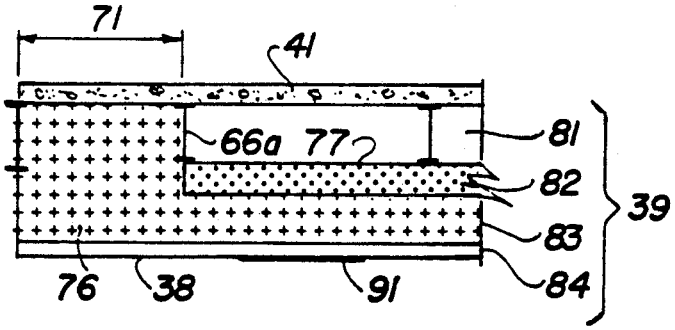
FIG. 11 is a cross-sectional view taken along line 11—11 of FIG. 10 showing use of beams for structural framing.

The manner in which the layers are assigned in the ceiling plenum 39 in each building block 22 is shown in FIGS. 11–15. In FIG. 11 the uppermost layer 81 underlying the concrete slab 41 is assigned to the beams 68*a* providing the structural framing in the plenum 39. The layer 82 below the layer 81 is assigned to pipes and wiring layer 83 therebelow is assigned to the air handling ducts and with the layer 84 being assigned to fire sprinklers.

Figure 12:
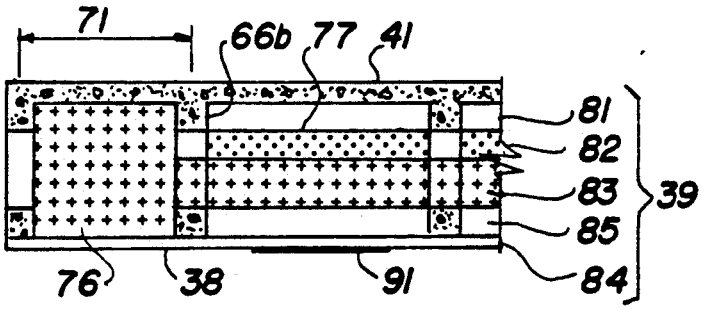
FIG. 12 is a view similar to FIG. 11 showing use of trusses for the structural framing.

When a different structural framing is utilized as for example, the trusses 66 shown in FIG. 12, another layer 85 is provided which is utilized for the bottom chord of the trusses utilized in the structural framing and the first layer 81 is utilized for the top chord of the same trusses. The layer 84 for the fire sprinklers thus becomes the fifth layer in the spacing allocation shown in FIG. 12. The distribution of the utilities across the area of the building block 22 is shown by the crosses and dots 76 and 77 in the appropriate areas. It will be noted that the areas containing the dots 77 therein extend in directions which are perpendicular to the directions of the areas in which the crosses 76 appear.

Figure 13:
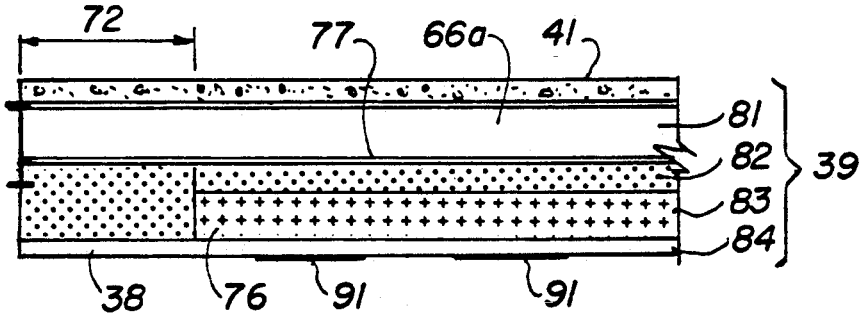
FIG. 13 is a cross-sectional view taken along line 13—of FIG. 10 and shows beams utilized for structural framing.
Figure 14:
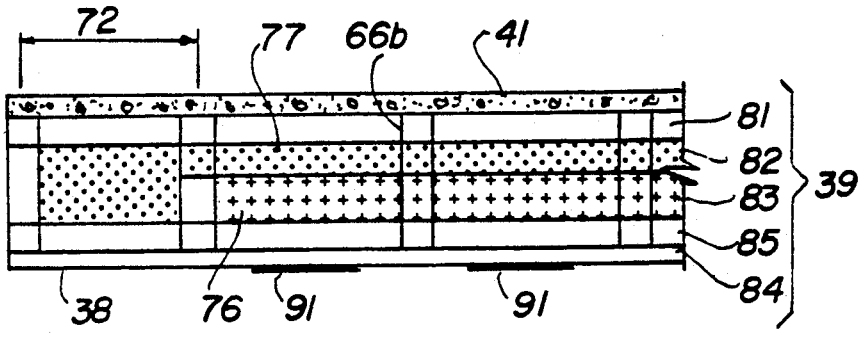
FIG. 14 is similar to FIG. 13 but shows trusses without diagonals for the structural framing.
Figure 15:
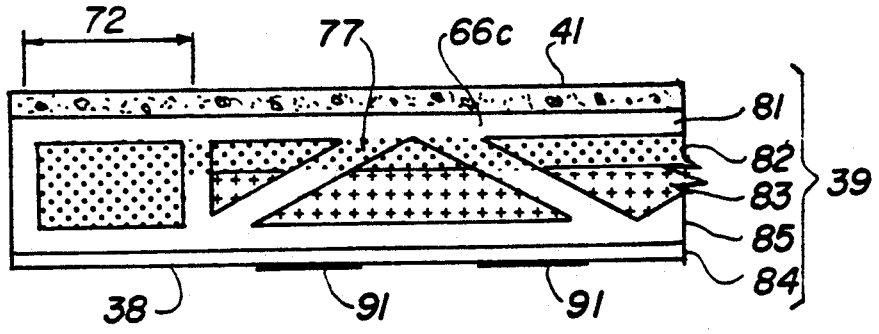
FIG. 15 is similar to FIG. 13 but shows trusses with diagonals being utilized for the structural framing.

The manner in which the spaces or layers are assigned the ceiling plenum 39 in directions that are perpendicular to the directions shown in FIGS. 11 and 12 is shown in FIGS. 13, 14 and 15. The areas assigned for the air handling ducts are provided with the crosses 76 whereas the areas provided for the pipes and wiring are provided with data 77. Again it can be seen that the air handling ducts travel in a direction which is perpendicular to the direction in which the pipes and wiring travel. It also can be seen from FIGS. 11–15, the space provided for the air handling ducts are substantially greater than that provided for the pipes and wiring to meet the typical requirements of a building.

Ceiling mounted lights 91 are provided on the ceilings which are connected to the appropriate electrical wiring provided in the ceiling plenum.

FIG. 2 is a perspective view showing the manner in which the assignments of the layers is accomplished in a building block. It shows a use in which the framing members 66 are in the form of Vierendeel truss structural framing members. The four corner minishafts 51, 52, 53, 54 extend vertically through the building block 22 and are connected to the supporting machinery located in the basement and/or on the roof and/or on intermediate floors. The minishafts 51, 52, 53, 54 contain the vertical routing of the utilities in which the air handling ducts in the vertical shafts 51, 52, 53, 54 are represented by incoming ducts 101 and outgoing ducts 102. The ducts 101 and 102 are connected to incoming ducts 103 and outgoing ducts 104 which extend in the channels 71 and 72 between the shafts 51 and 53 and the shafts 52 and 54. Ducts 106 are provided for distributing the incoming air throughout the area of the building structure and extend perpendicular to the ducts 103 through the truss framing members 66. The return air can be picked up in the ceiling plenum and returned through the outgoing ducts 104 to the ducts 101. The mechanical engineer can decide how to use the space assigned to him. He may have supply and return air in the same channel, or supply in one channel and return in the other. Pipes and wiring 111 extend vertically through the shafts 51, 52, 53, 54 are distributed through the area of the building block in runs 112 disposed in the channels 72 extending from the minishafts 51 and 52 and 53 and 54. The piping and wiring are distributed throughout the area of the building block by additional runs 113 which extend perpendicular to the runs 112 in the space allocated for the pipes and wiring.

It should be appreciated that it is not necessary to use all of the corners of the building block if not required to provide the desired utilities. For example, two corners on one side of the building block can be used for that purpose leaving the other two corners for other uses.

From the foregoing it can be seen that a building block has been provided which because of its standardized construction can utilize many prefabricated components simplifying and expediting the construction of a building, while at the same time reducing construction costs. The building blocks can be mounted side by side or on top of each other to provide the desired total building volume. When mounted side by side the floors in the building blocks can be at the same level to provide floors which extend continually from one building block to another. Preassigned spaces in the ceiling plenum are provided for the air handling ducts, piping, wiring and other services for the integrated building system and the method utilized therewith. The integrated building system and method minimizes the need for coordination of the work of different design disciplines involved in the building and should greatly minimize conflicts which occur during construction.

Resistance against lateral seismic and wind forces can be provided around the perimeter of the building block by moment resisting frames, brace frames or shear walls. The appropriate choice of the reinforcing utilized for the lateral load resistance may be dictated by architectural and functional requirements of the building. To be taken under consideration is the seismicity of the site to determine soil conditions, the overall building configuration and the natural vibration frequency of the building. In particularly seismically active areas, base isolation techniques can be utilized for earthquake protection of the building. Hybrid base isolation systems comprised of elastomeric bearings in combination with Teflon sliders may be selected. The base isolators may be provided under the columns. The Teflon sliders are located in the sub-basement and support only the basement floor above to cut down the span of the building block as for example, from 72 feet to 20–26 feet. There are no columns inside of the building block in the basement or above. These sliders working in tandem with the base isolators contribute to the damping of the integrated building system. Such base isolators and sliders can be located in a sub-basement.

I claim:

1. In a building system, a plurality of interconnected building blocks, each of the building blocks having framing providing a horizontally disposed vertically spaced-apart floor, ceiling and ceiling plenum and having at least three vertically extending corners with at least certain of the corners having vertical shafts formed therein extending from the floor to the ceiling plenum, said vertical shafts having air handling ducts and piping and wiring disposed therein, the ceiling plenum having spaced-apart parallel framing members extending in one direction of the ceiling plenum, air handling ducts connected to the air handling ducts in the vertical shafts and disposed in the ceiling plenum running in directions parallel to the framing members in the ceiling plenum, and piping and wiring connected to piping and wiring in the vertical shafts and disposed in the ceiling plenum and running in directions different from the directions of the framing members in the ceiling plenum.

2. A system as in claim 1 in which the air handling ducts are disposed below the piping and wiring in the ceiling plenum.

3. A system as in claim 1 wherein first and second spaced-apart parallel channels serving as air handling ducts are provided in the ceiling plenum and interconnected to the air handling ducts in said shafts, said first and second channels extending in directions parallel to the framing members and additional first and second spaced-apart parallel channels in the ceiling plenum and interconnected to the piping and wiring in the shafts and extending in directions perpendicular to the framing members.

4. A system as in claim 3 wherein said first named channels are disposed below the additional channels.

5. A system as in claim 3 wherein air handling ducts are provided in the ceiling plenums which are connected to the first named channels and extend in directions substantially perpendicular to the first named channels.

6. A system as in claim 3 wherein pipes and wiring are provided in the ceiling plenums which are connected to the additional channels and extend into directions which are generally perpendicular to the additional channels.

7. A system as in claim 1 wherein additional building services are provided in each building block and wherein the building services are disposed in preassigned vertically spaced-apart layers in the ceiling plenum.

8. A system as in claim 1 together with enclosures for stairs and elevators appended to the building blocks.

9. A system as in claim 1 wherein each of the building blocks is provided with framing around the perimeter of the building block to reset lateral forces produced by earthquakes and/or wind forces.

10. A system as in claim 1 in which certain of the building blocks are superposed with the vertical shafts being interconnected.

11. A system as in claim 10 in which the vertical shafts have vertical spaces therein which are segregated for air handling ducts and for piping and wiring.

12. A system as in claim 1 in which certain of the building blocks are disposed side by side to provide floors on the same level extending from one building block to another.

13. In a method for constructing a building by the use of a plurality of building blocks, forming each of the building blocks to provide horizontally disposed vertically spaced-apart floor, ceiling and ceiling plenums with at least three vertically extending corners, providing a vertically extending shaft on each of the corners extending from the floor to the ceiling plenum, providing structural framing in the ceiling plenum which is comprised of spaced-apart parallel frame members extending in one direction, providing in the ceiling plenum first and second spaced-apart parallel channels interconnecting the vertical shafts and extending parallel to the framing members to provide air handling ducts, and providing additional first and second spaced-apart parallel channels in the ceiling plenum interconnecting the vertical shafts to provide for piping and for wiring.

14. A method as in claim 13 together with the step of positioning the blocks so that they are disposed side by side and on top of each other with the vertical shafts being interconnected to provide the desired building space.

15. In a method for providing building services such as air, electricity, water and sewers in a building having corners and having ceiling plenums, providing vertically extending building services in the corners of the building and providing building services in the ceiling plenums which are connected to the vertically extending building services.

* * * * *